US007503299B2

(12) United States Patent
Matsuda

(10) Patent No.: US 7,503,299 B2
(45) Date of Patent: Mar. 17, 2009

(54) TWINCAM ENGINE AND MOTORCYCLE COMPRISING THE SAME

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 83 days.

(21) Appl. No.: 11/599,156

(22) Filed: Nov. 13, 2006

(65) Prior Publication Data

US 2007/0144477 A1 Jun. 28, 2007

(30) Foreign Application Priority Data

Nov. 16, 2005 (JP) ..... 2005-331873

(51) Int. Cl.
*F01L 1/18* (2006.01)

(52) U.S. Cl. ..... 123/90.39; 123/90.44; 74/569

(58) Field of Classification Search ..... 123/90.39, 123/90.44, 193.3, 193.5, 90.16, 90.2, 90.45, 123/90.46; 74/559, 567, 569
See application file for complete search history.

(56) References Cited

U.S. PATENT DOCUMENTS 3,144,013 A * 8/1964 Peras ..... 123/293
4,928,641 A * 5/1990 Niizato et al. ..... 123/90.16
5,033,422 A * 7/1991 Kurisu et al. ..... 123/90.27

FOREIGN PATENT DOCUMENTS

JP H03-15761 4/1991

* cited by examiner

*Primary Examiner*—Ching Chang
(74) *Attorney, Agent, or Firm*—Alleman Hall McCoy Russell & Tuttle LLP

(57) ABSTRACT

A twincam engine including a rocker arm configured to transmit rotation of a cam to reciprocate at least one of intake and exhaust valves, the rocker arm being pivotally attached to a cylinder head between a center axis of a valve stem of the intake valve and a center axis of a valve stem of the exhaust valve.

5 Claims, 5 Drawing Sheets

TWINCAM ENGINE AND MOTORCYCLE COMPRISING THE SAME

BACKGROUND OF THE INVENTION

1. Field of the Invention

The present invention relates to a twincam engine, and a motorcycle comprising the twincam engine. More particularly, the present invention relates to a construction for enabling an intake port and an exhaust port to have large curvature radiuses.

2. Description of the Related Art

For example, there is an inline four-cylinder four-cycle engine as an engine mounted in a motorcycle. Focusing attention on a valve system, there is a twincam engine (also referred to as DOHC (double overhead camshaft)) having rocker arms, as one type of the inline four-cylinder four-cycle engine. Such a twincam engine includes a camshaft configured to drive an exhaust valve and a camshaft configured to drive an intake valve, which are mounted between a cylinder head and a cylinder head cover and are disposed forward and rearward. These camshafts rotate in association with a crankshaft, and its rotation is transmitted through cams and the rocker arms to reciprocate the exhaust valve and the intake valve (see Publication of Japanese Examined Utility Model Application No. Hei. 3-15761).

A construction of the valve system will be described in detail. The exhaust valve and the intake valve are arranged forward and rearward for each cylinder, and their valve stems extend upward from their disc portions disposed at openings of the exhaust port and the intake port which are located on a combustion chamber side. A rocker arm on the exhaust valve side is disposed forward in the engine. A tip end portion of the rocker arm on the exhaust valve side is in contact with a valve lifter which is in contact with an upper end portion of the valve stem of the exhaust valve. The rocker arm is pivotally attached at a base end portion thereof to a cylinder head at a location forward of the valve stem by a pin. A rocker arm on the intake valve side is disposed rearward in the engine. A tip end portion of the rocker arm on the intake valve side is in contact with the valve lifter which is in contact with an upper end portion of a valve stem of the intake valve. The rocker arm is pivotally attached at a base end portion thereof to a cylinder head at a location behind the valve stem by a pin. The pin for mounting the rocker arm on the exhaust valve side extends in a rightward and leftward direction and is a common pin for the respective cylinders. The pin for mounting the rocker arm on the intake valve side is constructed in the same manner.

In the engine having the above constructed valve system, it is necessary to lay out the exhaust port and the intake port extending upward from the combustion chamber so as not to interfere with the pins located above the combustion chamber. For this reason, the exhaust port and the intake port must be respectively curved forward and rearward with relatively small curvature radiuses. If the curvature radius of the intake port is small, then it is difficult to improve air-intake efficiency. If the curvature radius of the exhaust port is small, then it is difficult to improve exhaust efficiency. This is undesirable to a high-output and high-speed engine. Such a circumstance occurs in twincam engines mounted in other vehicles as well as the engines mounted in the motorcycles.

SUMMARY OF THE INVENTION

In view of the foregoing, an object of the present invention is to provide a twincam engine that is devised of a construction of a valve system to enable an intake port and an exhaust port to have large curvature radiuses, and a motorcycle comprising the twincam engine.

The present invention has been made in view of the above circumstances, and a twincam engine of the present invention comprises a rocker arm configured to transmit rotation of a cam to reciprocate at least one of intake and exhaust valves, the rocker arm being pivotally attached to a cylinder head between a center axis of a valve stem of the intake valve and a center axis of a valve stem of the exhaust valve.

In such a construction, since a mounting position of the rocker arm is located closer to a center of the engine, limitation on the layout of at least one of intake and exhaust ports can be reduced, and thus at least one of them can have a larger curvature radius.

The twincam engine may further comprise a plurality of cylinders each having the rocker arm pivotally attached to the cylinder head by each separate pin. In such a construction, the pin can be made lightweight as compared to a case where an elongate common pin extending over the cylinders is used. Since each rocker arm is pivotally attached to the cylinder head by each separate pin as described above, the pivot of each rocker arm is laid out without limitation by the layout of an ignition plug mounted for each cylinder in the cylinder head between a camshaft configured to drive the exhaust valve and a camshaft configured to drive the intake valve.

The twincam engine may further comprise a holder that is mounted to the cylinder head and is configured to mount the rocker arm by the pin. The holder may have a bolt hole through which the holder is fastened to the cylinder head by a bolt and a plug hole into which an ignition plug is inserted. The bolt hole and the plug hole may be disposed to interpose a mounting position of the rocker arm between them. In such a construction, a portion of the holder for mounting the rocker arm is fastened to the cylinder head by inserting an ignition plug into the plug holder and by inserting the bolt into the bolt hole. As a result, the rocker arm is stably mounted.

A head portion of the bolt inserted into the bolt hole may be disposed opposite to an end portion of the pin mounted on the holder. In such a construction, the head portion of the bolt can inhibit the pin from coming off in one direction.

The holder may be formed of case-hardened steel that has been subjected to surface hardening treatment (e.g., carburizing or nitriding). In such a construction, wear resistance of the holder can be improved.

The cylinder head may be provided with a convex base portion to which the holder is fastened by the bolt, the base portion extending along a direction in which the cylinders are arranged. In such a construction, the holder can be stably fastened to the cylinder head and the stiffness of the cylinder head can be improved.

A motorcycle of the present invention includes any one of the above described twincam engines. In such a construction, limitations on the lay out of the intake port and the exhaust port can be reduced, and thus the intake port and the exhaust port can have larger curvature radiuses. As a result, air-intake efficiency and gas-exhaust efficiency can be improved. If the curvature radius of the intake port is made larger, then an opening of the intake port on the outer side of the engine can be oriented upward as compared to the conventional intake port. For this reason, the intake port of the engine of the present invention is suitable for use with an air-intake system of so-called downdraft air-intake system in which an air-intake passage extending from an air cleaner box to the intake port is oriented substantially vertically.

DETAILED DESCRIPTION OF THE PREFERRED EMBODIMENTS

Hereinafter, a twincam engine according to the present invention and a motorcycle comprising the twincam engine will be described with reference to the drawings. In this embodiment, the direction "forward" means the direction in which the motorcycle is traveling, and other directions mean directions from the perspective of a rider mounting the motorcycle using forward as a reference, except for a case specifically illustrated.

Figure 1:
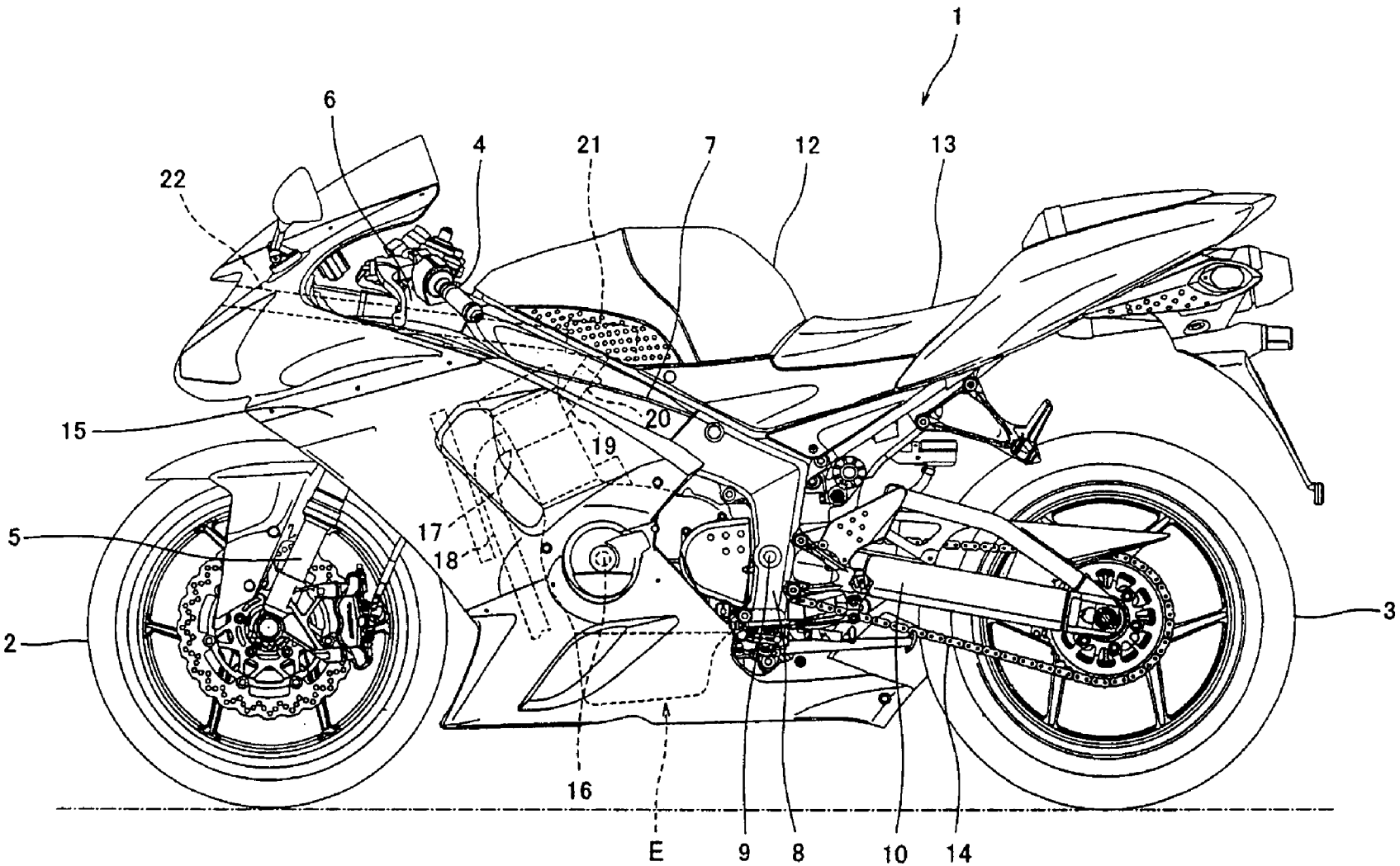
FIG. 1 is a left side view of a motorcycle according to an embodiment of the present invention.

FIG. 1 is a left side view of a motorcycle 1 according to an embodiment of the present invention. As shown in FIG. 1, the motorcycle 1 is of a road sport type and includes a front wheel 2 and a rear wheel 3. The front wheel 2 is rotatably mounted to a lower end portion of a front fork 5 extending vertically. The front fork 5 is mounted on a steering shaft (not shown) by an upper bracket (not shown) attached to an upper end thereof, and an under bracket located below the upper bracket. The steering shaft is rotatably supported by a head pipe 6. A bar-type steering handle 4 extending in a rightward and leftward direction is attached to the upper bracket. When the rider rotates the steering handle 4 clockwise or counterclockwise, the front wheel 2 is turned to a desired direction around the steering shaft.

A frame of the motorcycle 1 is of a twin tube type. A pair of right and left main frames 7 (only left main frame 7 is illustrated in FIG. 1) extend rearward from the head pipe 6. Pivot frames (swing arm brackets) 8 extend downward from rear regions of the main frames 7. A swing arm 10 is pivotally mounted at a front end portion thereof to a pivot 9 attached on the pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. A twincam engine (hereinafter simply referred to as an engine) E indicated by a broken line of FIG. 1 is mounted between and under the right and left main frames 7. The engine E is covered with a cowling 15 from the side to forward of the steering shaft (not shown). The engine E is an inline four-cylinder engine. The engine E is constructed in such a manner that a crankshaft 16 extends substantially in the rightward and leftward direction of the vehicle body. An output of the engine E is transmitted, through a chain 14, to the rear wheel 3, which thereby rotates. In this manner, the motorcycle 1 obtains a driving force.

An exhaust pipe 18 is coupled to an exhaust port 17 of the engine E to extend rearward from forward of the engine E through a region thereunder. A downstream end portion of a throttle device 20 is coupled to an air-intake port 19 of the engine E. An air cleaner box 21 is disposed between the right and left frames 7 and is coupled to an upstream end portion of the throttle device 20. An air-intake duct 22 extends forward from the air cleaner box 21. An upstream end of the air-intake duct 22 opens at a front portion of the cowling 15. The engine E is configured to take in air from outside using running wind (ram pressure). An air-intake system of the engine E of this embodiment is of so-called downdraft type in which an air-intake passage extending from the air cleaner box 21 to the air-intake port 19 through the throttle device 20 is oriented substantially vertically.

Figure 2:
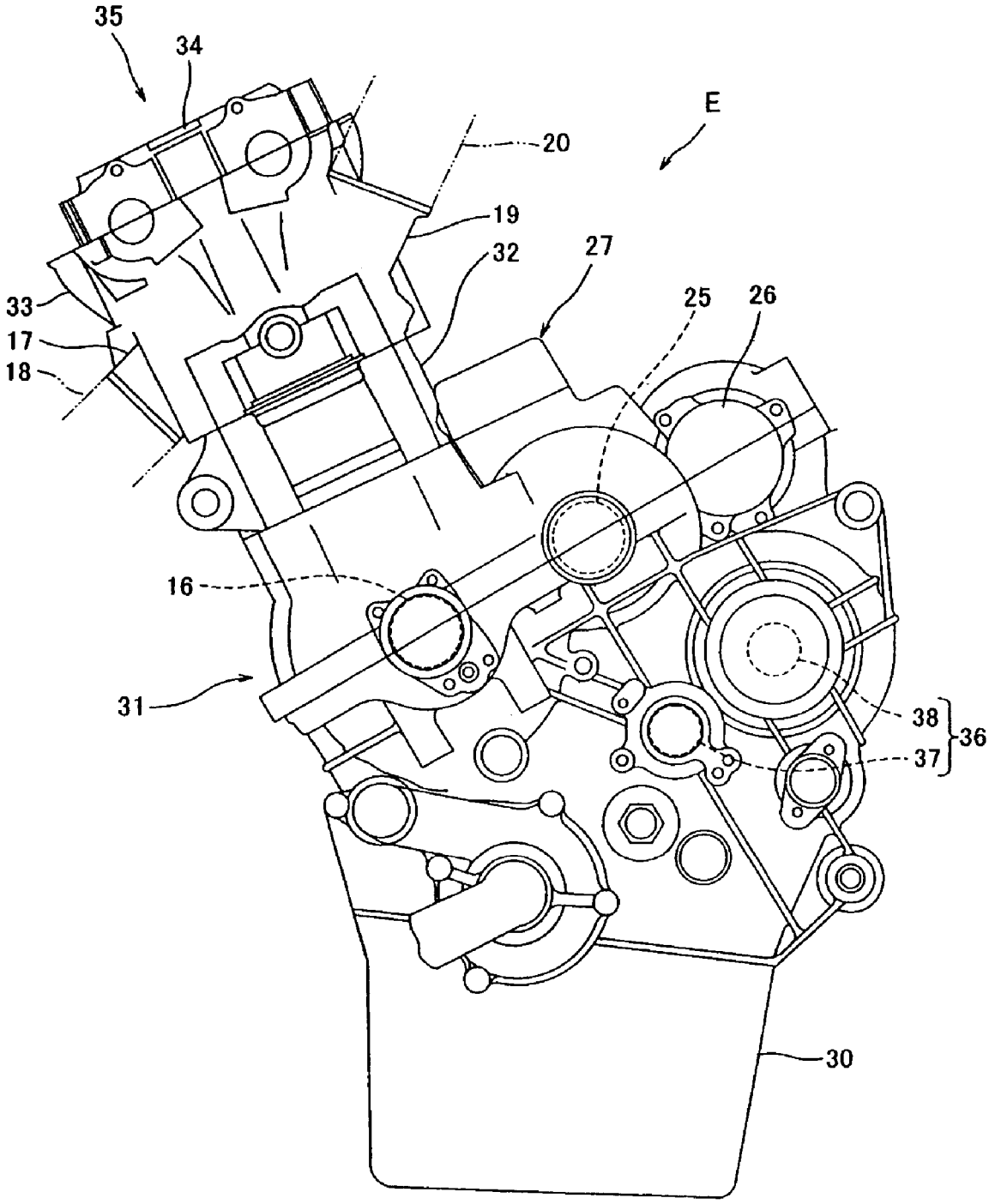
FIG. 2 is a left side view showing an engine of the motorcycle of FIG. 1.

FIG. 2 is a left side view showing the engine E of the motorcycle 1 shown in FIG. 1. The engine E includes an oil pan 30, a crankcase 31, a cylinder block 32, a cylinder head 33, and a cylinder head cover 34 arranged in this order from below. Each cylinder 35 is mainly composed of the cylinder block 32, the cylinder head 33, and the cylinder head cover 34 and is tilted forward with respect to a vertical direction of the vehicle body of the motorcycle 1. A crankshaft 16, a main shaft 37 and a counter shaft 38 forming a transmission 36, gears (not shown), etc., are accommodated in the interior of the crankcase 31.

The crankshaft 16 is mounted such that its center axis is oriented in the rightward and leftward direction as described above. The main shaft 37 is disposed behind the crankshaft 16 and extends substantially in parallel with the crankshaft 16. The countershaft 38 is disposed behind and obliquely above the main shaft 37 and extends substantially in parallel with the main shaft 37. A clutch (not shown) is mounted on one end of the main shaft 37. With the clutch in an on-state, a rotational force of the crankshaft 16 is transmitted to the main shaft 37. The speed of the rotational force of the main shaft 37 is reduced in a predetermined gear ratio and transmitted to the counter shaft 38. The rotational force is output from the countershaft 38 to the chain 14 shown in FIG. 1.

A balancer shaft 25 is disposed behind and obliquely above the crankshaft 16 and is configured to be rotatable in association with the crankshaft 16. A generator 26 for electric power generation is disposed behind and obliquely above the balancer shaft 25. An extra space is formed above the crankcase 31, below an intake port 19, and behind the cylinder block 32. A breather 27 is disposed in the space.

Figure 3:
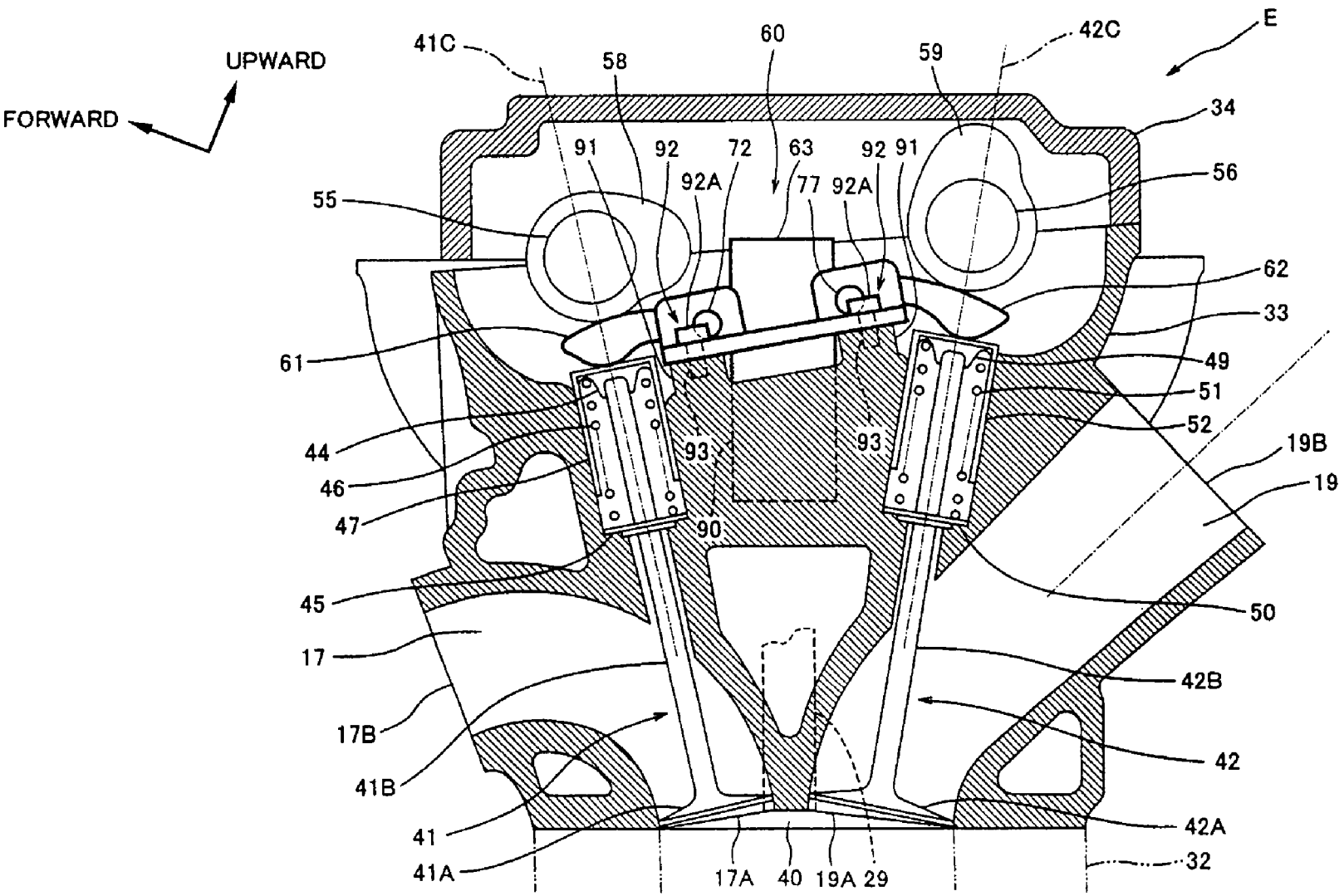
FIG. 3 is a cross-sectional view showing a cylinder head and a cylinder head cover of the engine of FIG. 2, which is shown to be cut away.

FIG. 3 is a cross-sectional view of the cylinder head 33 and the cylinder head cover 34 of the engine E of FIG. 2, which is cut away, showing a construction of a valve system and the exhaust port 17 and the intake port 19 as viewed from the left. As shown in FIG. 3, a combustion chamber 40 is formed at a lower region of the cylinder head 33 together with the cylinder block 32 so as to correspond to each cylinder. Two exhaust ports 17 (only a left exhaust port 17 is illustrated in FIG. 3) extend from front portions of one combustion chamber 40 and two intake ports 19 (only a left intake port 19 is illustrated in FIG. 3) extend from rear portions thereof.

To be specific, the exhaust port 17 extends substantially upward from an upstream opening 17A that opens in the combustion chamber 40 and then is curved forward at a position to a downstream opening 17B that opens forward and obliquely downward at a front wall portion of the cylinder head 33. The intake port 19 extends substantially upward from a downstream opening 19A that opens in the combustion chamber 40 and then is curved rearward at a position to an upstream opening 19B that opens upward and slightly obliquely rearward at a rear wall portion of the cylinder head 33.

Two exhaust valves 41 and two intake valves 42 are accommodated in the cylinder head 33 for each cylinder to open and close the two exhaust ports 17 and the two intake ports 19, respectively. The engine E is of a four-valve type. A valve disc 41A of the exhaust valve 41 is disposed near the upstream opening 17A of the exhaust port 17. The valve stem 41B extends substantially upward from the valve disc 41A. A valve disc 42A of the intake valve 42 is disposed near the downstream opening 19A of the intake port 19. The valve stem 42B extends substantially upward from the valve disc 42A. As viewed from the side, the exhaust valve 41 and the intake valve 42 are disposed in such a manner that the valve stems 41B and 42B form a substantially V-shape.

An upper retainer 44 is in contact with an upper end portion of the valve stem 41B of the exhaust valve 41 from above. A lower retainer 45 is loosely fitted at a position of the valve stem 41B and supported on the cylinder head 33. The upper retainer 44 and the lower retainer 45 are arranged vertically with a valve spring 46 interposed therebetween. The upper retainer 44 and an upper portion of the valve spring 46 are accommodated in a tubular valve lifter 47 (see FIG. 4) having an opened lower end and a closed upper end.

In the same manner, an upper retainer 49 is in contact with an upper end portion of the valve stem 42B of the intake valve 42 from above. A lower retainer 50 is loosely fitted at a position of the valve stem 42B and supported on the cylinder head 33. The upper retainer 49 and the lower retainer 50 are arranged vertically with a valve spring 51 interposed therebetween. The upper retainer 49 and an upper portion of the valve spring 51 are accommodated in a tubular valve lifter 52 (see FIG. 4) having an opened lower end and a closed upper end.

The valve lifters 47 and 52 are fitted into cylindrical concave portions formed at an upper region of the cylinder head 33 from above. The valve lifters 47 and 52 are located to be vertically reciprocatable along respective center axes 41C and 42C of the valve stems 41B and 42B, and are biased upward by forces applied from the valve springs 46 and 51 through the upper retainers 44 and 49, respectively.

A camshaft 55 configured to drive the exhaust valve 41 is disposed above the exhaust valve 41 and a camshaft 56 configured to drive the intake valve 42 is disposed above the intake valve 42. The camshaft 55 and the camshaft 56 are disposed and supported between an upper portion of the cylinder head 33 and a lower portion of the cylinder head cover 34. The camshaft 55 and the camshaft 56 are arranged forward and rearward such that their center axes extend in the rightward and leftward direction. The camshaft 55 and the camshaft 56 are coupled to the crankshaft 16 of the engine E of FIG. 2 through a sprocket and a chain (or pulley and belt, gear train) which are not shown. The camshaft 55 and the camshaft 56 are configured to rotate in association with the rotation of the crankshaft 16 in a cycle twice as long as that of a cycle in which the crankshaft 16 rotates.

Cams 58 and 59 are attached to suitable locations of the camshaft 55 and the camshaft 56 so as to correspond to the exhaust valve 41 and the intake valve 42, respectively. The cams 58 and 59 are rotatable integrally with the camshaft 55 and the camshaft 59, respectively. The cams 58 and 59 apply forces through the rocker arms 61 and 62, which are pivotally attached to a holder 60, described later, to press the valve lifters 47 and 52, respectively.

Figure 4:
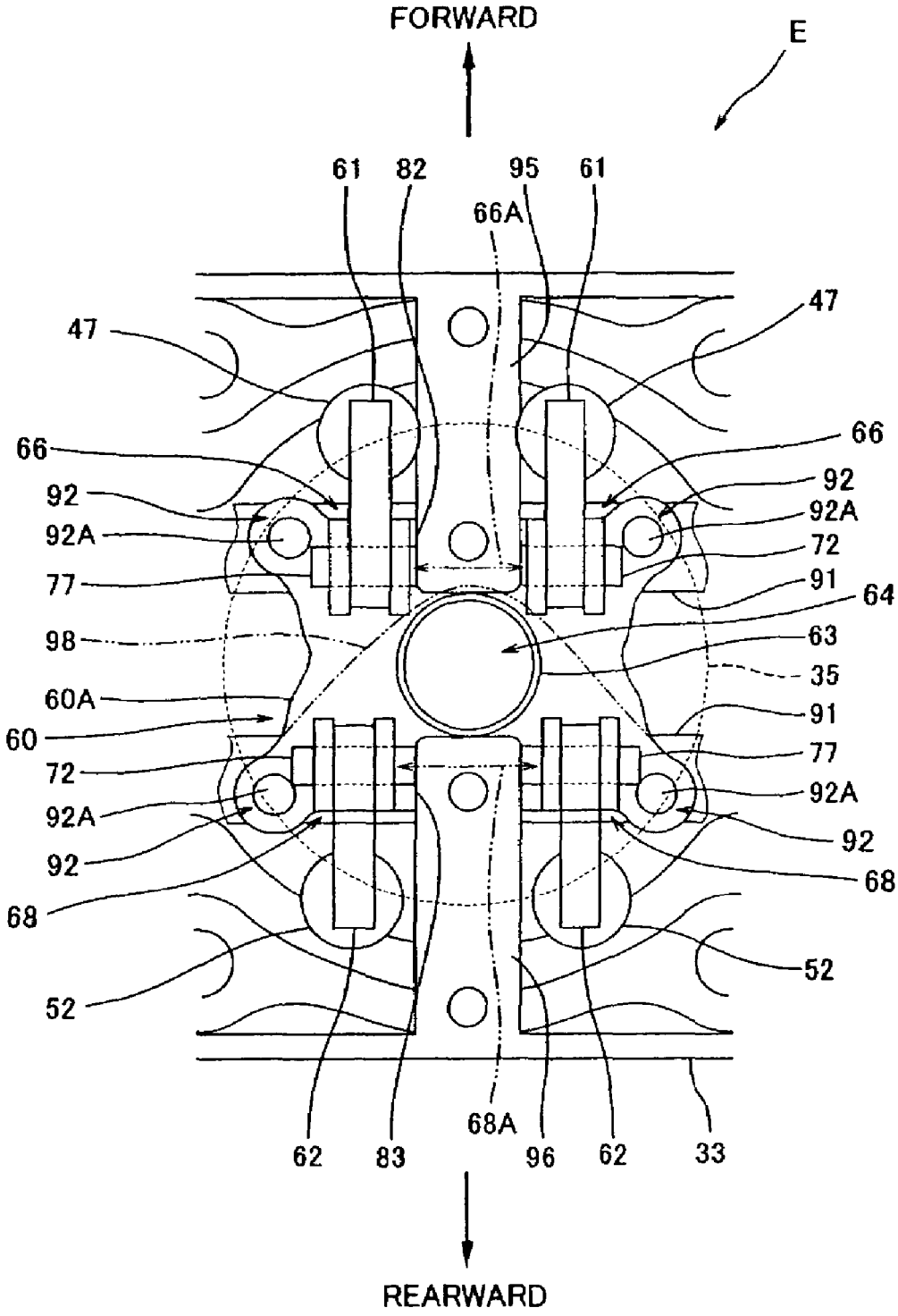
FIG. 4 is a plan view showing a construction of a valve system, with the cylinder head cover removed from a cylinder of the engine of FIG. 2.

FIG. 4 is a plan view of the construction of the valve system, with the cylinder head cover 34 removed from a cylinder. As shown in FIGS. 3 and 4, a holder 60 is mounted for each cylinder at a substantially center position in a forward and rearward direction at an upper region of the cylinder head 33 to pivotally attach the rocker arms 61 and 62. As shown in FIG. 4, the holder 60 is of a substantially rectangular shape in which front and rear regions and right and left regions are symmetrically cut away as viewed from above, like a butterfly with its wings spread, for example. The holder 60 of this embodiment is made of case-hardened steel that has been subjected to surface hardening treatment such as carburizing or nitriding to provide stiffness.

Figure 5:
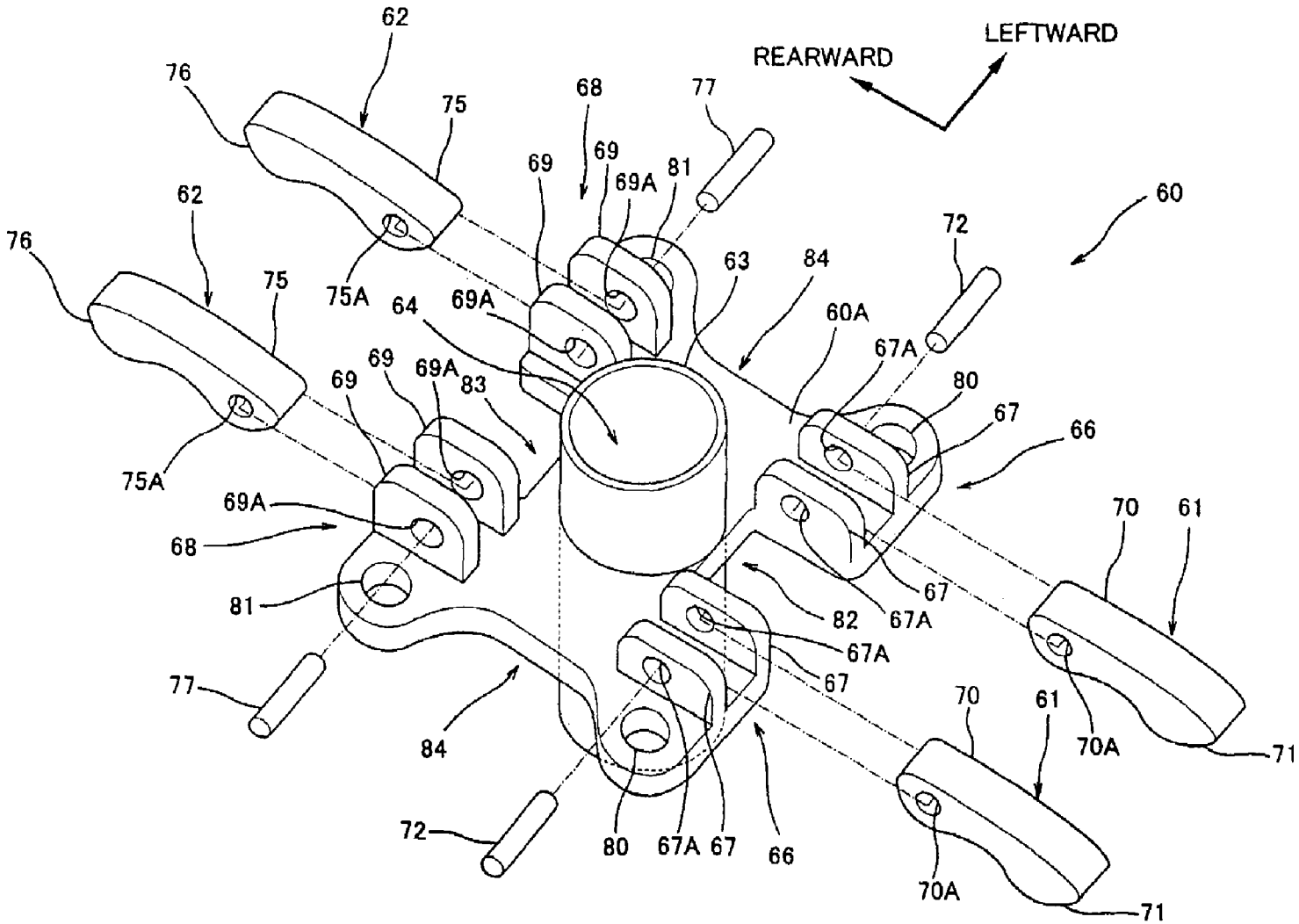
FIG. 5 is a perspective view showing a construction of a holder and rocker arms of the valve system of FIG. 4.

As shown in a perspective view of FIG. 5, the holder 60 has a base plate 60A constructed such that a tubular member 63 that is vertically elongate penetrates a center region thereof. The tubular member 63 has a plug hole 64 into which an ignition plug 29 of the engine E is inserted. Mounting portions 66 are provided on right and left sides in front of the plug hole 64 on the base plate 60A to mount the two rocker arms 61 on the exhaust valve side. Each mounting portion 66 is formed of right and left plate-shaped boss portions 67 protruding opposite to each other from the base plate 60A. Holes 67A are formed to penetrate in the rightward and leftward direction of the plate-shaped boss portions 67 to be coaxial with each other.

Mounting portions 68 are provided on right and left sides behind the plug hole 64 on the base plate 60A to mount the two rocker arms 62 on the intake valve side. Each mounting portion 68 is formed of right and left plate-shaped boss portions 69 protruding opposite to each other from the base plate 60A. Holes 69A are formed to penetrate in the rightward and leftward direction of the plate-shaped boss portions 69 to be coaxial with each other. As shown in FIG. 4, a spacing 68A between the right and left mounting portions 68 disposed at a rear region of the holder 60 (i.e., intake valve side) is larger than a spacing 66A between the right and left mounting portions 66 disposed at a front region of the holder 60 (i.e., exhaust valve side) (see FIG. 5).

A hole 70A is formed on each rocker arm 61 on the exhaust valve side to penetrate in the rightward and leftward direction of a base end portion 70 thereof, and a lower region of a tip end portion 71 located forward relative to the base end portion 70 protrudes downward. The rocker arm 61 is pivotally attached to the holder 60 in such a manner that the base end portion 70 is placed between the right and left plate-shaped boss portions 67 of the front mounting portion 66 of the holder 60 and the pin 72 is inserted into the holes 67A of the plate-shaped boss portions 67 and the hole 70A of the base end portion 70 which are coaxially aligned. The rocker arm 61 on the exhaust valve side is pivotally attached to the holder 60 such that the tip end portion 71 is vertically pivotable around the hole 70A formed on the base end portion 70.

Likewise, a hole 75A is formed on each rocker arm 62 on the intake valve side to penetrate in the rightward and leftward direction of a base end portion 75, and a lower region of a tip end portion 76 located rearward of the base end portion 75 protrudes downward. The rocker arm 62 is pivotally attached to the holder 60 in such a manner that the base end portion 75 is placed between the right and left plate-shaped boss portions 69 of the rear mounting portion 68 of the holder 60 and the pin 77 is inserted into the holes 69A of the plate-shaped boss portions 69 and the hole 75A of the base end portion 75 which are coaxially aligned. The rocker arm 62 on the intake valve side is pivotally attached to the holder 60 such that the tip end portion 76 is vertically pivotable around the hole 75A formed on the base end portion 75.

Bolt fastening holes 80 are formed on outer sides in the rightward and leftward direction of the front two mounting portions 66 to vertically penetrate the base plate 60A of the holder 60. To be specific, the mounting portion 66 is interposed between the plug hole 64 formed at the center of the base plate 60A and the bolt fastening hole 80. Likewise, bolt fastening holes 81 are formed on outer sides in the rightward and leftward direction of the rear two mounting portions 68 of the holder 60 to vertically penetrate the base plate 60A of the holder 60. To be specific, the mounting portion 68 is interposed between the plug hole 64 and the bolt fastening hole 81.

On the base plate 60A, a rectangular cut portion 82 is formed between the front two mounting portions 66 and is located in front of the plug hole 64, and a rectangular cut portion 83 is formed between the rear two mounting portions 68 and is located behind the plug hole 64. Furthermore, on the base plate 60A, a cut portion 84 is formed at each of right and left sides of the plug hole 64, i.e., between the bolt fastening holes 80 and 81 formed forward and rearward at each of the left and right sides. The holder 70 is lightweight because the base plate 60A has these cut portions 82 to 84.

The above constructed holder 60 is mounted on base portions 91 that are formed at upper regions of the cylinder head 33 and have a convex shape as viewed from the side with the tubular member 63 forming the plug hole 64 fitted into a cylindrical concave portion 90 formed at a center region of the upper portion of the cylinder head 33. The base portions 91 are formed forward and rearward with the concave portion 90 interposed between them, and extend in the rightward and leftward direction over the four cylinders 35 (see FIG. 4) arranged in line, improving stiffness of the cylinder head 33. The holder 60 is fastened to the cylinder head 33 in such a manner that bolts 92 are inserted into the bolt fastening bolts 80 and 81 (see FIG. 5) formed at corner regions of the base plate 60A from above and are threaded into threaded holes 93 formed on the base portions 91.

As shown in FIG. 3, the base portions 91 are disposed between a center axis 41C of the valve stem 41B of the exhaust valve 41 located forward and a center axis 42C of the valve stem 42B of the intake valve 42 located rearward. The pins 72 and 77, for pivotally attaching the rocker arms 61 and 62 to the holder 60 fastened to the base portion 91 by the bolts, are located between the center axes 41C and 42C. Because of the absence of any structural elements for pivotally attaching the rocker arms 61 and 62 outside (forward and rearward) of the center axes 41C and 42C, the exhaust port 17 and the intake port 19 can have larger curvature radiuses to easily extend upward from the combustion chamber 40. Because the exhaust port 17 and the intake port 19 can have larger curvature radiuses, gas-exhaust efficiency and air-intake efficiency are improved in the engine E of this embodiment.

As shown in FIGS. 3 and 4, head portions 92A of the bolts 92 are located in close proximity to the outer end portions of the pins 72 and 77 pivotally attaching the rocker arms 61 and 62. In other words, as viewed from the side along the center axes of the pins 72 and 77 as shown in FIG. 3, the head portions 92A of the bolts 92 and the pins 72 and 77 at least partially overlap with each other. With such a construction, the head portions 92A of the bolts 92 inhibit the pins 72 and 77 from coming off outward.

As shown in FIG. 4, rectangular separating wall portions 95 and 96 extend for each cylinder from front and rear wall portions of the cylinder head 33 toward a center portion of the cylinder head 33. The separating wall portions 95 and 96 serve to improve stiffness of the cylinder head 33 and are configured to conform in shape to the front and rear cut portions 82 and 83 of the base plate 60A of the holder 60, facilitating assembling of the holder 60 into the cylinder head 33. Furthermore, since the separating wall portions 95 and 96 are opposite to inner end portions of the pins 72 and 77 with the holder 60 assembled into the cylinder head 33, they serve to inhibit the pins 72 and 77 from coming off inward (toward the center in the rightward and leftward direction of each cylinder).

In accordance with the engine E, as described above, the exhaust port 17 and the intake port 19 are configured to have larger curvature radiuses to improve gas-exhaust efficiency and air-intake efficiency. Also, the motorcycle 1 of this embodiment employs a downdraft-type air-intake system, in which an air-intake passage extending from the air cleaner box 21 to the intake port 19 through the throttle device 20 is oriented substantially vertically. Therefore, the engine E, which allows the intake port 19 to have larger curvature radius, is especially suitable for the motorcycle 1 having such a construction.

The holder 60 is fastened to the cylinder head 33 by the ignition plug 29 inserted into the tubular member 63 and the bolts 92 inserted into the holes 80 and 81, so as to interpose the mounting portions 66 and 68 for mounting the rocker arms 61 and 62 by the pins 72 and 77 between the ignition plug 29 and the bolts 92, so that the holder 60 stably supports the pivots of the rocker arms 61 and 62 by using the bolts 92. In addition, since each rocker arm 61 is pivotally attached to the cylinder head 33 by each separate pin 72 and each rocker arm 62 is pivotally attached to the cylinder head 33 by each separate pin 77, the pivots can be laid out flexibly as compared to the case where adjacent right and left rocker arms 61 are pivotally attached by a common pin, for example. Thus, limitation on the lay out of the pivots of the rocker arms 61 and 62 because of the presence of the tubular member 63 forming the plug hole 64, etc., can be reduced.

Whereas description has been made to explain that the rocker arm 61 on the exhaust valve side and the rocker arm 62 on the intake valve side are pivotally attached by the integral holder 60 between the center axis 41C and the center axis 42C located forward and rearward, they may be pivotally attached thereto by separate holders, or otherwise one of them may be pivotally attached between the center axes 41C and 42C. For example, in a case where only the rocker arm 62 on the intake valve side is pivotally attached to the cylinder head 33 between the center axes 41C and 42C, a portion on the intake valve side of the holder 60 of FIG. 4 that is obtained by cutting the base plate 60A along two-dotted line 98 may be used.

Whereas an engine E mounted in the motorcycle 1 of a road sport type has been described in this embodiment, the engine may be mounted to motorcycles of other types, or personal watercraft or four-wheeled all terrain vehicles.

Numerous modifications and alternative embodiments of the invention will be apparent to those skilled in the art in view of the foregoing description. Accordingly, the description is to be construed as illustrative only, and is provided for the purpose of teaching those killed in the art the best mode of carrying out the invention. The details of the structure and/or function maybe varied substantially without departing from the spirit of the invention and all modifications which come within the scope of the appended claims are reserved.

What is claimed is:

1. A twincam engine comprising:

a rocker arm configured to transmit rotation of a cam to reciprocate at least one of intake and exhaust valves, the rocker arm being pivotally attached to a cylinder head between a center axis of a valve stem of the intake valve and a center axis of a valve stem of the exhaust valve;

a plurality of cylinders each having the rocker arm pivotally attached to the cylinder head by each separate pin; and a holder that is mounted to the cylinder head and is configured to mount the rocker arm by the pin;

wherein the holder has a bolt hole through which the holder is fastened to the cylinder head by a bolt and a plug hole into which an ignition plug is inserted; and wherein the bolt hole and the plug hole are disposed to interpose a mounting position of the rocker arm between them.

2. The twincam engine according to claim 1, wherein a head portion of the bolt inserted into the bolt hole is disposed opposite to an end portion of the pin mounted to the holder.

3. The twincam engine according to claim 1, wherein the holder has a surface that has been subjected to surface hardening treatment.

4. The twincam engine according to claim 1, wherein the cylinder head is provided with a convex base portion to which the holder is fastened by the bolt, the base portion extending along a direction in which the cylinders are arranged.

5. A motorcycle comprising a twincam engine including:

a rocker arm configured to transmit rotation of a cam to reciprocate at least one of intake and exhaust valves, the rocker arm being pivotally attached to a cylinder head between a center axis of a valve stem of the intake valve and a center axis of a valve stem of the exhaust valves;

a plurality of cylinders each having the rocker arm pivotally attached to the cylinder head by each separate pin; and a holder that is mounted to the cylinder head and is configured to mount the rocker arm by the pin;

wherein the holder has a bolt hole through which the holder is fastened to the cylinder head by a bolt and a plug hole into which an ignition plug is inserted; and wherein the bolt hole and the plug hole are disposed to interpose a mounting position of the rocker arm between them.

* * * * *